US008073359B2

(12) United States Patent
Moore

(10) Patent No.: US 8,073,359 B2
(45) Date of Patent: Dec. 6, 2011

(54) DISTRIBUTED BELT MODULE FOR A MODULAR PRINTING SYSTEM

(75) Inventor: Steven R Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 471 days.

(21) Appl. No.: 12/275,385

(22) Filed: Nov. 21, 2008

(65) Prior Publication Data

US 2010/0129114 A1 May 27, 2010

(51) Int. Cl.
*G03G 15/00* (2006.01)
*G03G 15/16* (2006.01)

(52) U.S. Cl. ..... 399/109; 399/110; 399/121

(58) Field of Classification Search ..... 399/107, 399/109, 110, 121
See application file for complete search history.

(56) References Cited

U.S. PATENT DOCUMENTS 5,119,133 A * 6/1992 Swain ..... 399/163
7,336,917 B2 * 2/2008 Asaoka et al. ..... 399/116
7,793,777 B2 * 9/2010 Parks ..... 399/121 X
2002/0136566 A1 * 9/2002 Hamada et al. ..... 399/121
2003/0152400 A1 * 8/2003 Maier et al. ..... 399/121
2010/0086327 A1 * 4/2010 Hollar et al. ..... 399/110

* cited by examiner

*Primary Examiner* — Sophia S Chen
(74) *Attorney, Agent, or Firm* — Richard A. Castellano; Prass LLP

(57) ABSTRACT

A system for support, operation, installation, and removal of an endless belt in a scalable modular printing system includes an input module, at least one marking module, and an output module. The endless belt is an intermediate transfer belt, a photoconductive belt, or a sheet transport belt used in the marking system. Rollers support an interior surface of the belt, and are supported by their respective module frame structures, thus defining a vacant interior cavity of the belt. A method of belt installation includes drawing all interior rollers out of their frame structures, placing the pre-scrolled belt at one end module of the system, uncoiling the belt along its process direction within the internal cavity of the system, then reinstalling the interior rollers to capture the belt into its operating position.

19 Claims, 8 Drawing Sheets

DISTRIBUTED BELT MODULE FOR A MODULAR PRINTING SYSTEM

This invention relates to a system comprising an endless belt used in cooperation with one or more marking modules and, more specifically, to a system used to support, operate, remove and install such an endless belt.

BACKGROUND

While the present invention of endless belt support, operation, installation and removal can be effectively used in a plurality of different belt configurations, it will be described for clarity as used as an intermediate transfer belt (ITB) in electrostatic marking systems such as electrophotography or xerography. It is to be appreciated that for other electrophotographic applications the invention can be applied to photoreceptor belts and media transport belts. It is to be further appreciated that the invention can be applied to systems using other marking technologies, including ink jet, solid ink, offset, dye sublimation technologies to the extent that systems can be constructed in the same modular fashion as described here.

It is advantageous for future marking systems to become modular in construction. This has been the focus of present research. It is well known that benefits of a modular marking system are broad market and application coverage by assembling different systems from a core set of modules (i.e., monochrome, highlight color, 4-color, 6-color, etc. systems), and reduced manufacturing costs and field service costs due to economies of increased volumes of a small set of core modules. In this invention, it is assumed there is a base marking module capable of creating at least a single color separation. A printing system is constructed from 1 to N of these marking modules along with supporting input and output modules. For current printing systems, the value of N may be 6 or 7, however there is utility in systems that can achieve N of 8. From both a technical and financial perspective, a "global" belt transport, either sheet transport, photoreceptor, or ITB, is clearly advantaged over having modular transports within each marking module. Such a global belt is required to span from the input module, across each marking module, and the output module. Historically, such belt transports require purpose-built belt modules that cannot be readily modularized. The dilemma is to provide all the advantages of a global belt transport while still retaining the essential modularity desired for future marking apparatus.

By way of background, in marking systems such as xerography or other electrostatographic processes, a uniform electrostatic charge is placed upon a photoreceptor belt or drum surface. The charged surface is then exposed to a light image of an original to selectively dissipate the charge to form a latent electrostatic image of the original. The latent image is developed by depositing finely divided and charged particles of toner upon the belt or drum photoreceptor surface. The toner may be in dry powder form or suspended in a liquid carrier. The charged toner, being electrostatically attached to the latent electrostatic image areas, creates a visible replica of the original. The developed image is then usually transferred from the photoreceptor surface to an intermediate transfer belt (ITB) or to a final media such as paper.

In some of these electrostatic marking systems, a photoreceptor belt, an intermediate transfer belt (ITB), or a media transport belt is generally arranged to move in an endless path through the various processing stations of the xerographic marking process. In this endless path, several xerographic-related stations are traversed by the belt which becomes abraded and worn. Since the belt is used continuously, the surfaces of the belt may be constantly abraded and cleaned by a blade and/or brushes and prepared to be used once again in the marking process. The belt may be exposed to friction or heat and moved by rollers that provide the belt movement to accomplish the belt purpose. There is further the possibility of damaging the belt surface or edge from extrinsic sources such as inadvertent contact by the machine operator or service technician. Therefore, generally, after a period of operation, especially in high speed color systems, the belt needs to be replaced.

Image-carrying belts used in color printing processes can be especially difficult to replace and install. In some machines for example, the intermediate transfer belt is over 6-10 feet long and travels past a plurality of marking stations. Belt installation requires careful alignment between the belt rollers to prevent belt and other machine component damage. In a scalable modular printing system, even longer belt lengths may be required, and the belt replacement or removal operation is increasingly difficult without belt damage occurring.

Even in monochromatic marking systems that use shorter belts for various functions, extreme care must be taken not to damage the belts during installation. In some instances, the belts are constructed of thin flexible polymeric materials that can easily scratch or be damaged during belt replacement or even during original installation. Photoreceptor, ITB, and media transport belts are generally supported within a printing system by a belt module. The belt module is comprised of an integral frame assembly which supports multiple rollers. The rollers provide drive force, tensioning, steering, stabilization, and other functions to support and operate the belt. Generally, the belt module resides within the interior of the belt, that is, it occupies the volume defined by the periphery of the interior surface of the belt. Thus, there exists a substantial frame structure internal to the belt which is carefully designed to support the specific length of the belt. The frame structure is further designed to provide accurate location of rollers and resist deformation due to external loads. Most commonly, belts are installed onto a belt module by sliding the belt over the outside periphery of the belt module. The direction of belt installation is thus perpendicular to the direction of belt travel during operation. It is generally not possible to design stationary frame members that would obstruct any portion of the belt module periphery. Thus, although the existence of the belt module provides a stable support for the belt, it also places design constraints upon the system frame design, in particular the need for unobstructed access to at least one side of the belt module. This consideration, together with the previously cited concerns, points to a need for an improved method of support, operation, installation, and removal of global belts within a modular scalable printing system.

SUMMARY

According to one aspect of the application, a modular printing system is provided, comprising: an input module, an output module, at least one marking module, said marking module positioned between said input module and said output module, each of said marking modules comprising at least one marking station, a belt operating in cooperation with the marking modules and spanning across the input module, each marking module, and the output module, at least one roller in the input module providing support for said belt, at least one roller in the output module providing support for said belt, wherein said rollers are detachably supported by their respective module frames and said rollers wholly support said belt.

According to another aspect of the application, a method of installing a belt in a modular printing system is provided, comprising the steps of: providing at least two rollers to support said belt, providing means to detachably mount said rollers to the frame structure of said system, drawing said rollers out of said frame structure, placing set belt in coil form within said frame structure, extending said belt to its operating position, and restoring said rollers to their original location, thereby capturing said belt in its operating position.

DETAILED DISCUSSION OF DRAWINGS AND PREFERRED EMBODIMENTS

With incorporation of this invention, a photoreceptor, ITB, or media transport belt can be supported and operated without any integral frame located interior to the belt. Instead, rollers that are required for belt support and operation are supported wholly by a frame structure located external to the belt. Therefore, the only components located interior to the belt are the rollers themselves and thus the interior volume of the belt which conventionally is taken by a dedicated belt module is essentially vacant. The invention is described herein as a 'distributed belt module', since the functions that are incorporated within a conventional monolithic belt module are instead distributed across the multiple modules of the system. As will be described, adoption of the distributed belt module provides important advantages in achievement of a scalable, modular printing system.

Figure 1:
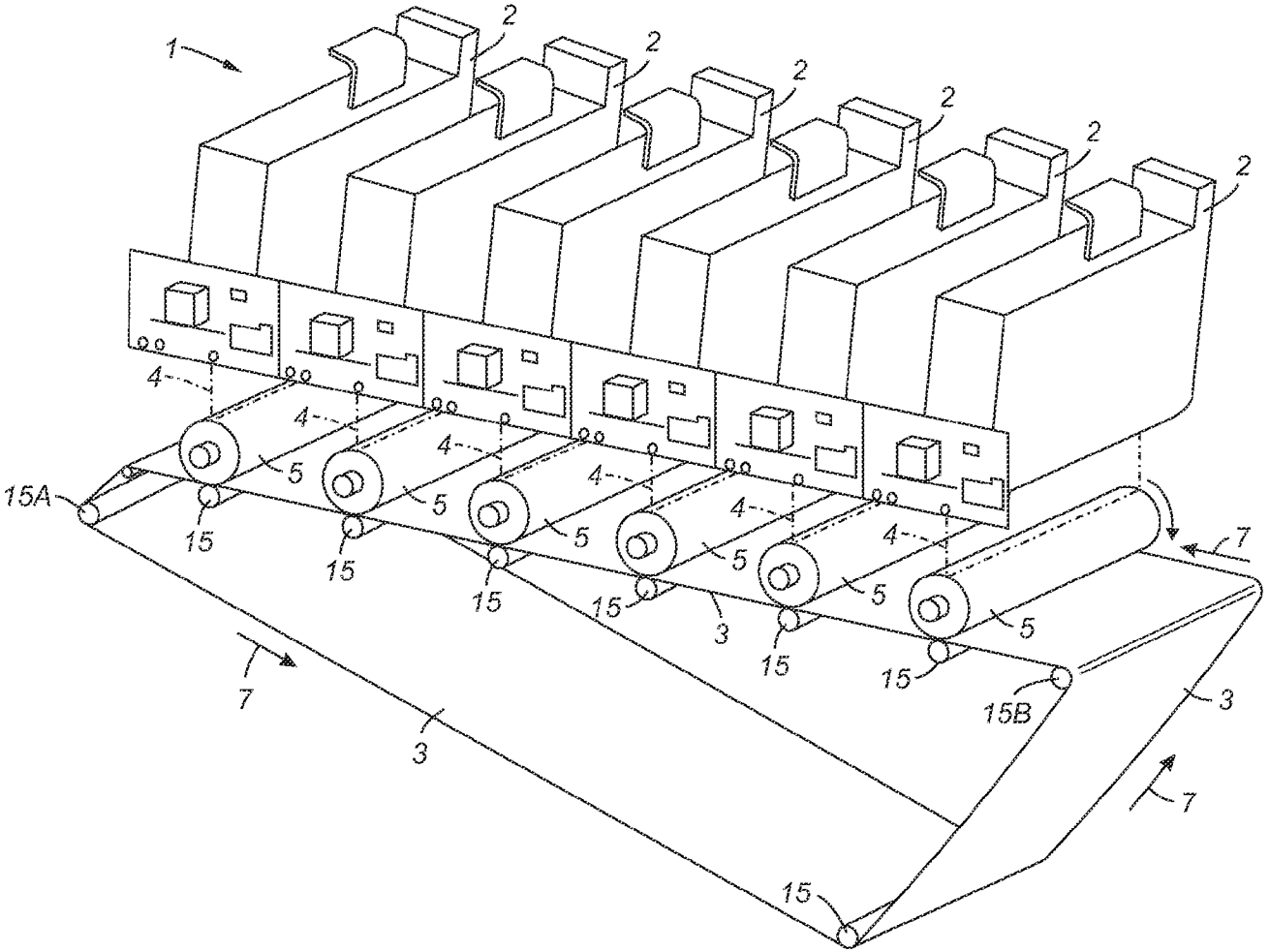
FIG. 1 illustrates a six module marking system with an endless intermediate transfer belt (ITB) that can be supported by the system of this invention.

In FIG. 1, a typical color, six module imaging system 1 is illustrated having an array of raster output scanners (ROS) 2 and their associated photoreceptor drums 5 aligned above an endless intermediate transfer belt 3. This arrangement will be referred to herein as "customary marking systems" or "customary color marking systems" or "customary xerographic marking system(s) or stations". Each ROS emits a different image beam 4 on a photoconductive drum 5 to charge the drum's surface where the image for that color will be located. As the drum 5 rotates, the charged regions pick up toner of the color for that particular imaging station and transfer this color image to the surface of the ITB belt 3 so that each colored image is deposited in relation to the previous deposited image. At the end of the process, all six deposited images (that are color developed at each station) are precisely aligned to form the final color image which is eventually transferred to media. The arrows 7 indicate the rotation direction of drum 5 and belt 3. According to conventional practice, an integral frame structure (not shown in FIG. 1) is provided within the volume defined by the interior surface of belt 3, the purpose of which is to support rollers 15, 15A, and 15B. This integral structure is referred to here as the belt module. The belt module thus provides support and operation for the belt. If a belt must be changed for any of the reasons discussed earlier, the belt must be removed and replaced from the belt module. This generally entails removing tension from the belt, sliding the belt off the belt module in a direction perpendicular to the belt direction of travel, then reversing these steps to install a replacement belt. A typical xerographic four color imaging system that is representative of the configuration as above described is disclosed in U.S. Pat. No. 6,349,192. This patent disclosure is incorporated by reference into the present disclosure.

Figure 2:
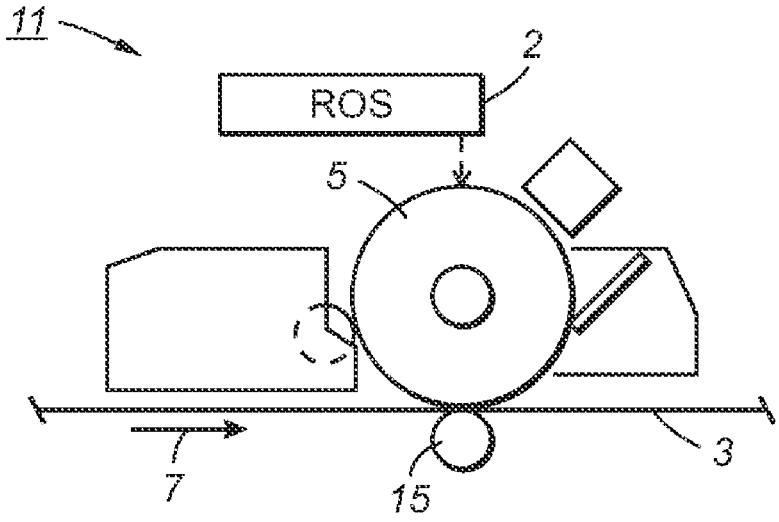
FIG. 2 illustrates a drum based print engine capable of generating a single color separation.

In FIG. 2 is shown the front view of a drum-based print engine capable of generating a single color separation. The xerographic components are arranged differently from FIG. 1 but provide the same functions. The developed toner image is transferred at the 6 o'clock position to either the belt 3 (for an ITB system) or onto a sheet of paper being escorted by the belt 3 (for a direct to paper transfer system).

Figure 3:
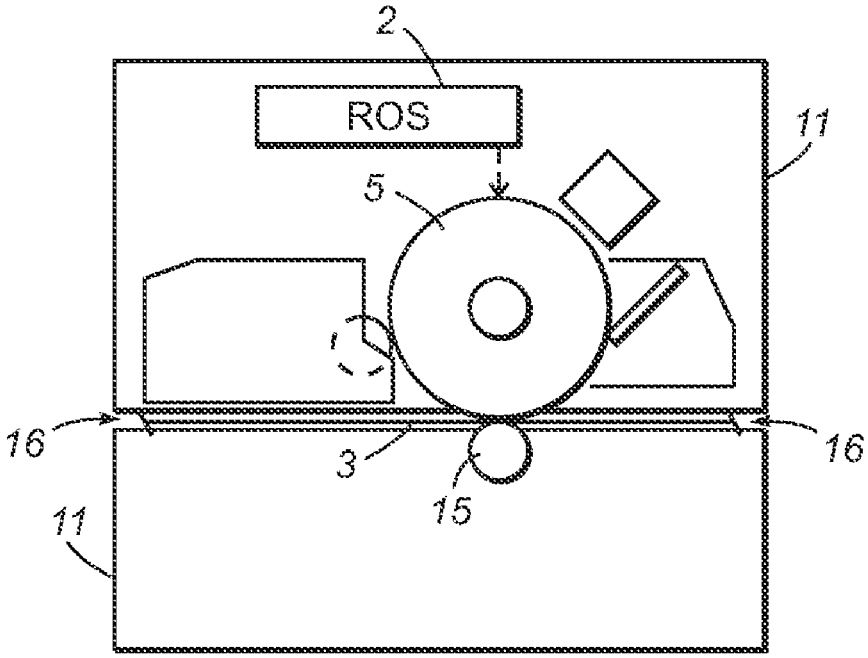
FIG. 3 illustrates the print engine within a marker module.

In FIG. 3, the print engine is shown within a marker module 11. The single separation marker module 11 becomes the core module to create a family of printing systems. In this Figure, the upper span of belt 3 is simply shown to span from the module input plane to its output plane as shown, use of a single "global" belt transport that spans across multiple marker modules is reliable, cost effective and straightforward. However, the existence of belt 3 is clearly detrimental to the desired goal of a highly modular printing system, since the belt itself is not modular.

Figure 4:
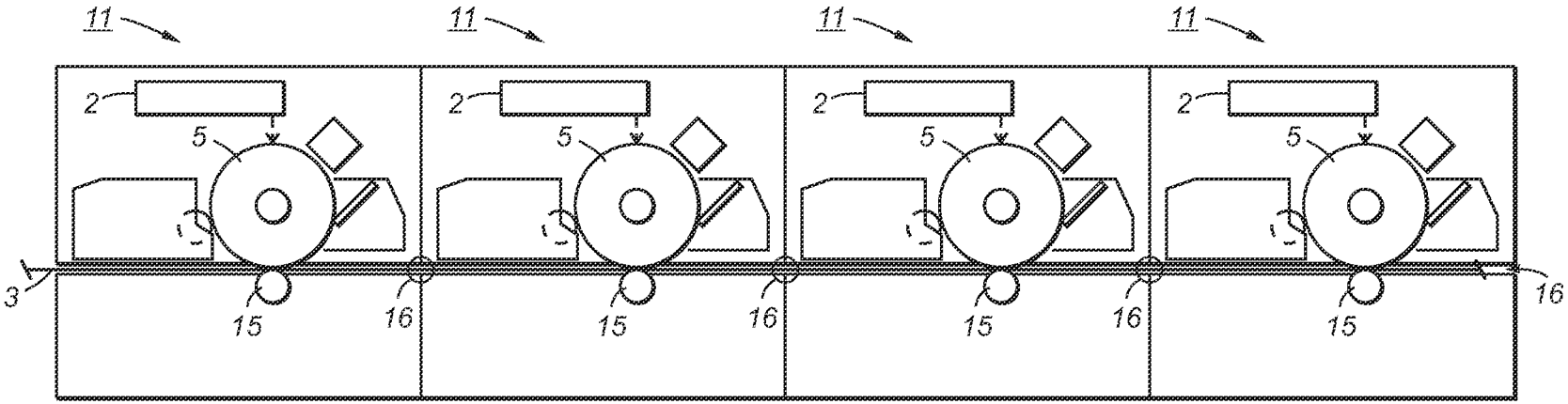
FIG. 4 illustrates a typical four module-color printing system constructed of four marker modules.

FIG. 4 shows a representative 4-color printing system constructed from four marker modules 11. A single shared belt spans the four marker modules 11. It is apparent that a monochrome, highlight color, 6-color or other printing configuration could likewise be constructed from this same core module arrangement.

Figure 5:
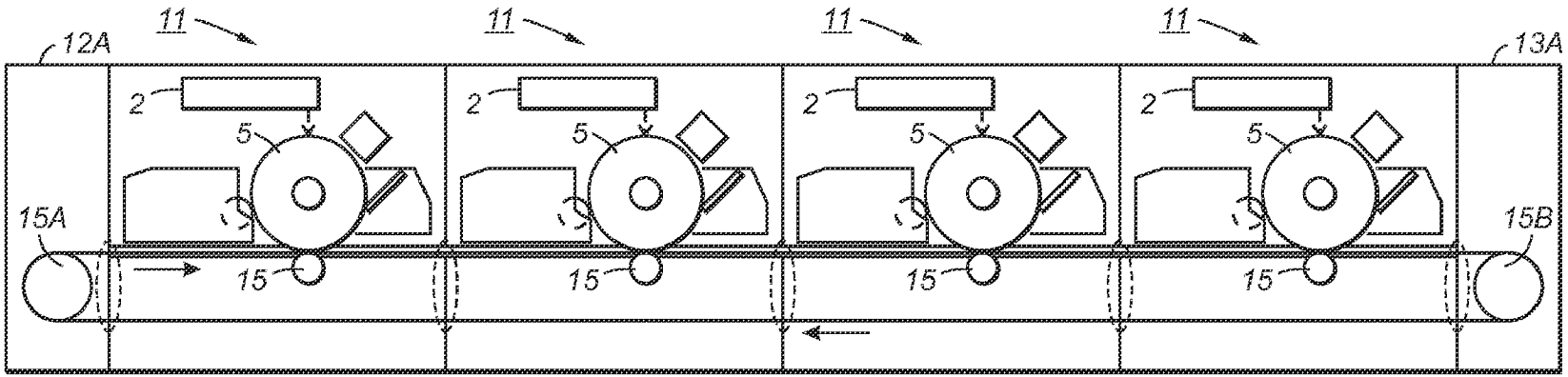
FIG. 5 shows an expanded representation of the four color printing system of FIG. 4 with a conventional belt module supporting the belt which spans the input, marking, and output modules.

FIG. 5 shows an expanded representation of the 4-color printing system. Now shown also is an input module 12A (at left) and an output module 13A (at right). A conventional belt module can thus be constructed that houses the global belt. This figure also suggests a very significant design challenge. A global belt 3 supported by a conventional belt module is designed to be accessible from the front of the system. Thus, frames interferences exist where shown between the module frames and the belt module. A typical solution is to cantilever the frames from the rear of the system to allow for unobstructed front access. This requires much more sophisticated frames design than simple "box" frames. A further issue is the scalability of this architecture. A 6-color printing system of FIG. 1 would require a unique large belt module. Although belt modules themselves could be constructed in a modular fashion, it would be advantageous not to have to manufacture and inventory multiple unique belt modules. While only four or six marking modules are shown in the drawings FIGS. 4 and 5, any number of marking modules that are suitable may be used.

Figure 6:
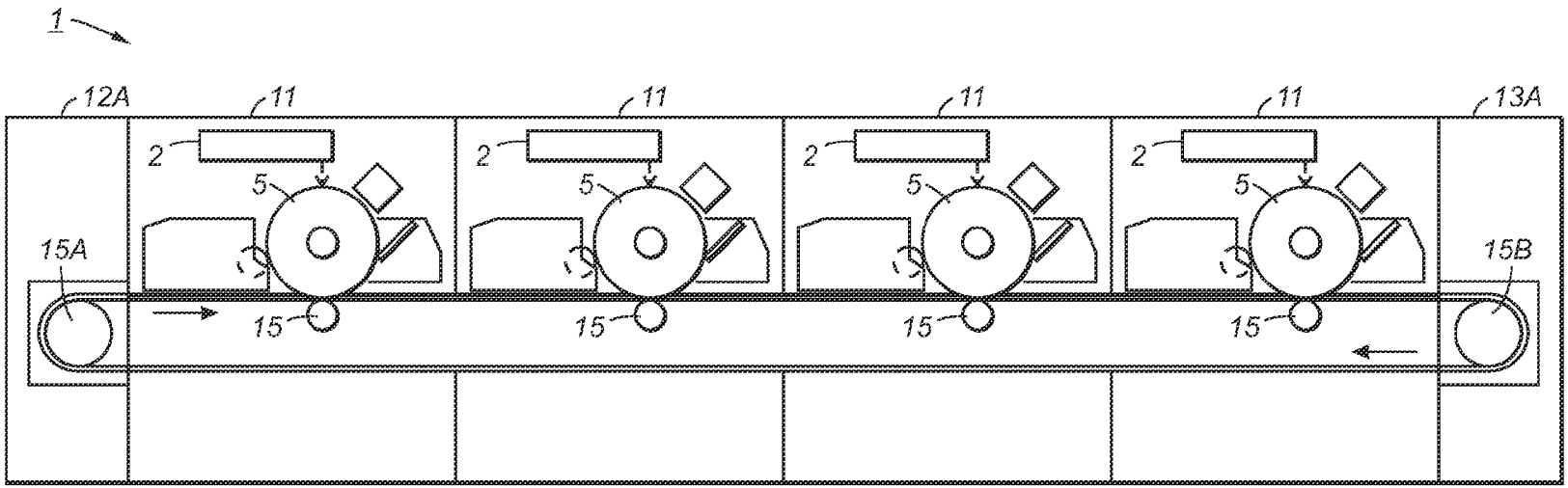
FIG. 6 shows a four marking module system utilizing a distributed belt module with an input module at its left end and an output module on its right terminal end.

FIG. 6 shows a similar modular 4-color printing system but now without a conventional belt module. Instead, the functions of the belt module are distributed throughout the modules comprising the printing system. The frame structure which locates the belt rollers 15 now consists of the printing system frame structure, which is in turn is comprised of the various individual module frames rigidly connected to one another. In this example, the input module 12 contains a sub frame 12A that houses one roller or set of rollers 15A and the output module 13 contains a sub frame 13A that houses the opposite roller or set of rollers 15B. Each marker module contains a portion of the belt module function related to transfer of image content to the belt or media on the belt, shown as roller 15. For an ITB architecture, the input module 12 may contain the belt driver roller and tensioning roller, each marking module may contain a first transfer Bias Transfer Roll (BTR) and the output module 13 may contain the lateral steering roller, the second transfer backup roller and the second transfer BTR. An advantage of this approach is that it is much more scalable than the configuration in FIG. 5. To create a 6-color printing system of FIG. 1, one would only need to add two additional marker modules and switch to a longer belt 3—a single part change. It is apparent that the two sub frames 12A and 13A at opposite ends of the distributed belt module can be aligned sufficiently to each other, either via module frames tolerance control or via a post-assembly adjustment so that the belt process and cross-process motion controls can be enabled. Note that non-scalable items such as the belt drive/steering/stripping/tension rollers, belt motor, belt cleaner, registration sensors, etc. would all be preferably located in either the input or output modules. All scalable items such as first bias transfer roll BTR and inter-transfer charge conditioners would be resident in the marker module. It is known that certain belt manufacturing methods, such as ultrasonic welding of lap seams, readily lends itself to the creation of multiple belt lengths. Thus, by manufacturing and inventorying four or more different length belts, the input, marker and output modules shown can be used to create a wide variety of printing systems.

Figure 7:
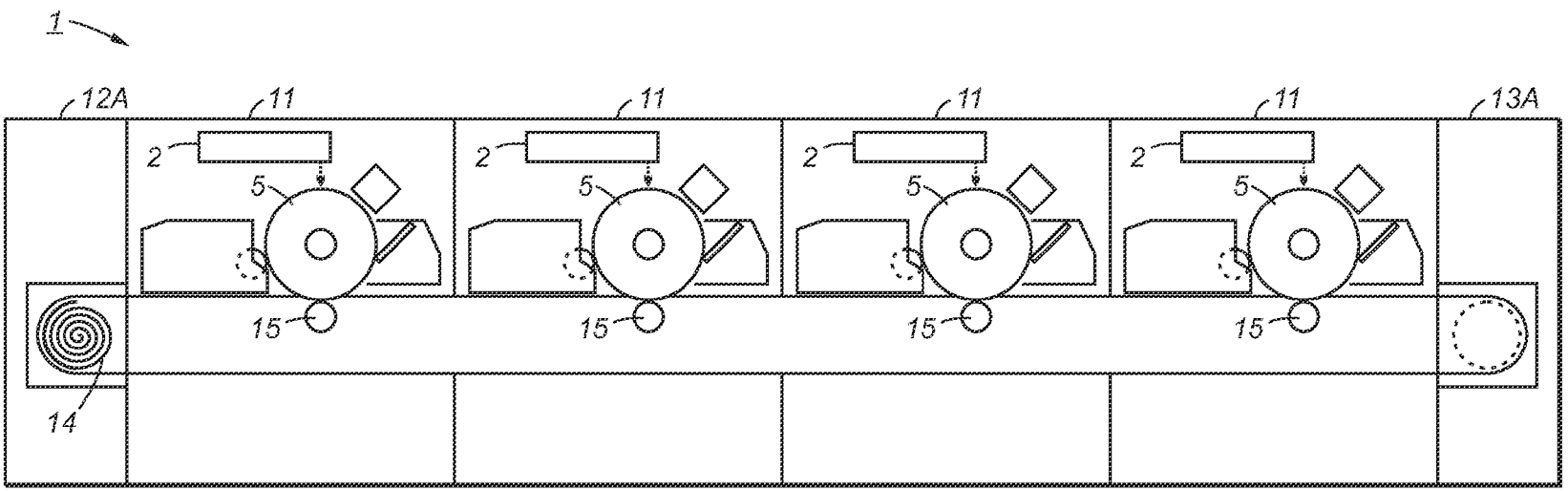
FIG. 7 shows a four marking module system with a coiled belt positioned in the input module. If suitable, the coiled belt can be in the output module.
Figure 8:
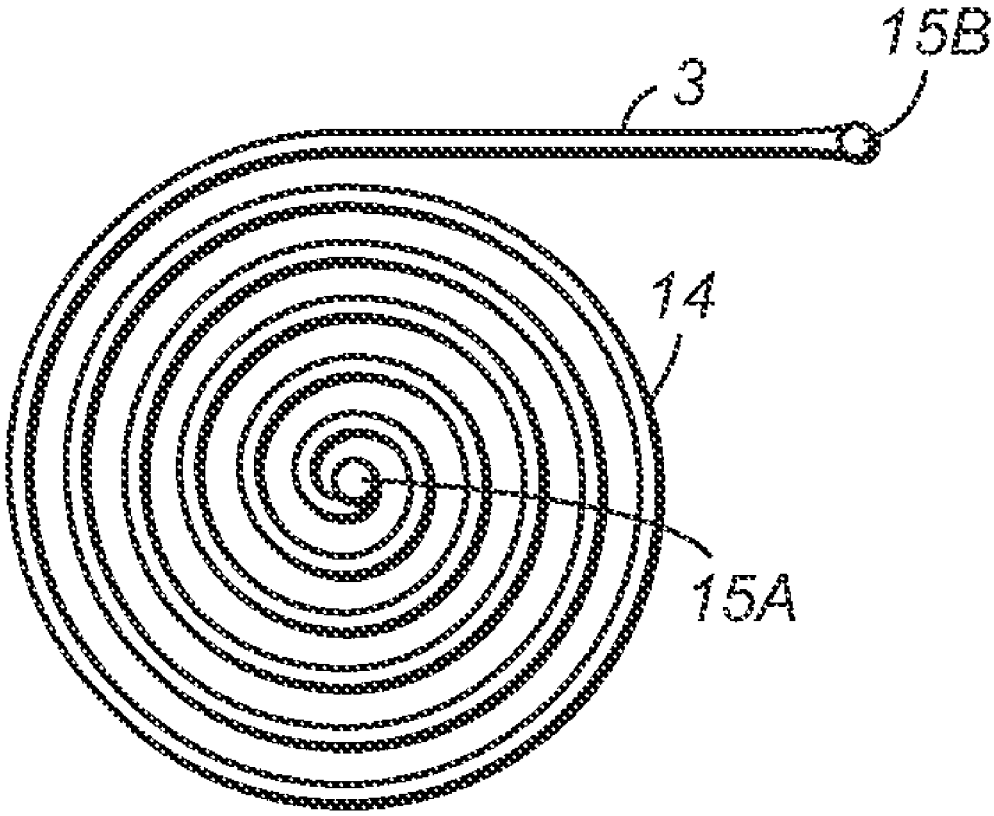
FIG. 8 shows an expanded view of the coiled belt as it reaches the output module and roller.

FIG. 7 shows another capability that can be provided by a distributed belt module. It is assumed that this system is made using modules with simple, sturdy box frames. Thus, the existence of front vertical frame members precludes any front access for installing or removing the belt 3. A different approach can be used since the cavity conventionally filled by a belt module is largely vacant. The belt 3 will be installed in coiled form 14 into the input module 12 via front access (or, alternatively, in the output module 13 or any other point with convenient local front access). Once within the input module 12, the belt 3 is uncoiled and stretched and pulled along the printing process direction until it spans into the output module 13. This requires that each roller 15, 15A, and 15B normally on the inside of the belt first be removed. This invention provides that these inside rollers be designed so they can be moved along their longitudinal axes (in cross-process direction) either inboard or preferably outboard of their normal operating position 1, either individually or in unison. This allows the rollers to vacate the internal cavity 16 through which the belt will span. This invention also proposes that a belt "puller" mechanism can be optionally provided to assist electrically, mechanically or manually in uncoiling and guiding the belt through the internal cavity, cavities or openings 16 of the system. The "puller", not shown, could be as simple as a flat tape measure contained in the output module that can be deployed (extended) to the left until it attaches to the belt or preferably to features on a belt core roll. The "puller" is then retracted which pulls the belt from left to right as shown in FIG. 7. Any suitable puller may be used. Once the belt spans from input to output module, the inside rollers 15, 15A, 15B can be reinstalled, thus capturing the belt 3 in place. The first BTRs 15 and the belt tensioning roller 15A can now be tensioned and the belt is ready for use. Belt removal is essentially the same steps in reverse. By installing the belt along its process motion direction, one source of belt infant mortality (belt damage induced by installation) can be reduced. It is also provided that the described belt installation procedure could be performed by a trained operator thus significantly reducing service cost attributed to the belt. FIG. 8 shows an expanded view of the coiled belt 14 as it reaches the output module 12 and roller with inside rollers 15A and 15B.

Figure 9:
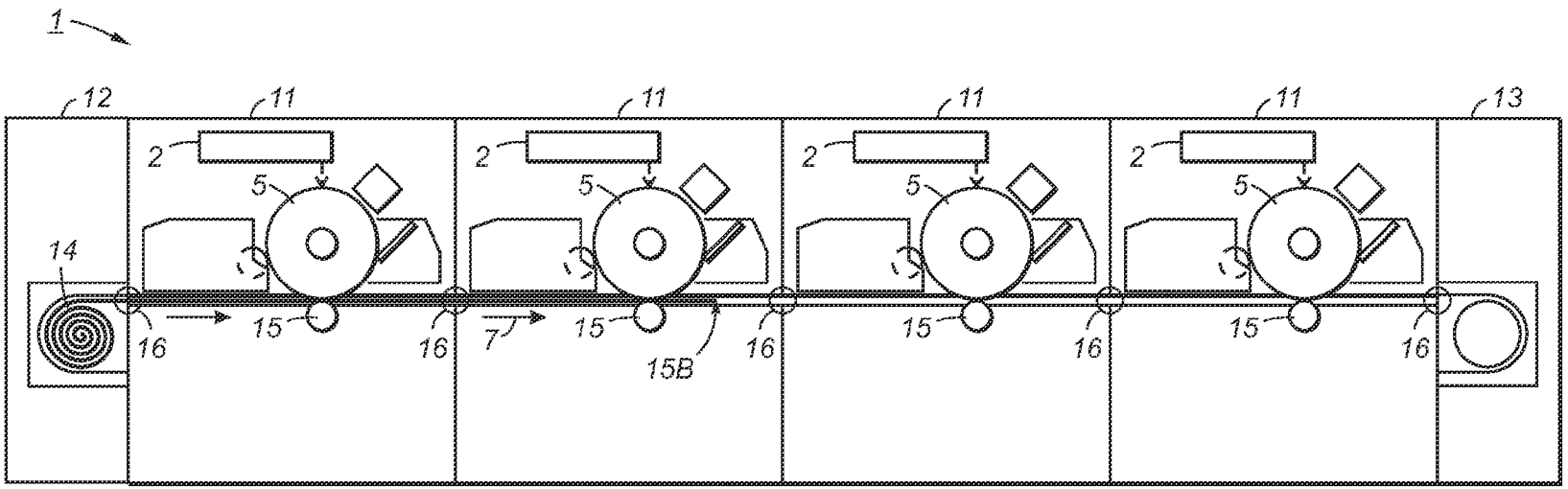
FIG. 9 shows the coiled belt being pushed or pulled from the input module through the marking modules to the output module where it is uncoiled and connected around an end tension roller.

In FIG. 9, the coiled belt 14 is pulled through internal cavities of marker modules 11 until belt 3 spans from the input module 12 to output module 13. All inside rollers 15, 15A, and 15B are now pushed back into machine 1 thus capturing belt 3 into place ready to be used.

It should be apparent that other belt installation and removal methods are also possible for the described distributed belt module. In another embodiment, in order to install belt 3, all rollers 15 and 15B are made movable along the belt process direction so as to be moved from their normal operating location to a location into module 12, to be in close proximity to roller 15A. With all the rollers so situated in module 12, it is possible to install the coiled belt 14 such that the belt interior surrounds all of the rollers. Rollers 15 and 15B can then be moved back to their original positions, which serves to uncoil the belt. When the rollers 15 and 15B are returned fully to their normal operating positions, the coiled belt 14 has now assumed the desired belt shape 3.

In summary, embodiments of this invention provide a modular printing system comprising an input module, an output module and at least one marking module. The marking modules are positioned between the input module and the output module.

Each of the marking modules comprises a marking engine capable of creating at least one color separation and has removable rollers, if needed, to support the endless belt during the image transfer step. The input module or output module comprises rollers to support and operate the endless belt. The rollers are detachably supported by the input and output module frames. Hence there is no frame structure within the interior volume of the belt needed for the purpose of belt support. The belt is configured to be extended through the marking modules to be supported by one or more rollers in the output module and one or more rollers in the input module. A modular printing system so defined would typically consist of 1 to 8 marking modules. By adopting the described structure of a distributed belt module, different printing system configurations can be assembled from the three base modules (input, marking, output) by simply providing multiple length belts. Thus a high degree of modularity is provided despite the existence of the global belt which itself is inherently not modular.

A method for belt installation and removal within the distributed belt module has been described. For belt installation, all interior rollers supporting the belt are first removed, preferably by drawing them out the front of their respective modules, thus evacuating the cavity in which the belt resides. Secondly, the belt is prescrolled so that it can be placed into a specified module, such as the input module. Thirdly, the belt is extended through the cavity within the printing system until it spans the input, marking, and output modules. Finally, the drawn out rollers are reinserted into their respective modules, thus capturing the belt into place. Belt removal is accomplished by reversing the above sequence. At least one alternate embodiment for belt installation and removal has been described.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A modular printing system comprising:

an input module, an output module, and at least one marking module, said marking module positioned between said input module and said output module, each of said marking modules comprising at least one marking stations, a belt operating in cooperation with the marking modules and spanning across the input module, each marking module, and the output module, at least one roller in the input module providing support for said belt, at least one roller in the output module providing support for said belt, wherein said at least one roller in the input module and at least one roller in the output module are detachably supported by their respective module frames and said at least one roller in the input module and at least one roller in the output module wholly support said belt.

2. The printing system of claim 1 wherein at least one of said roller in the input module and said roller in the output module is a driver roller.

3. The printing system of claim 1 wherein at least one of said roller in the input module and said roller in the output module is a tensioning roller.

4. The printing system of claim 1 wherein said belt is configured at any length conforming to the distance between said roller in said input module and said roller in said output module.

5. The printing system of claim 1 wherein each of said marking modules contains removable marking module rollers.

6. The printing system of claim 1 comprising from one to eight marking modules.

7. The printing system of claim 1 comprising modules having travel spaces for said belt to travel through during belt installation, and each module having removable rollers at all belt interior locations.

8. The marking system of claim 1 comprising said belt positioned in coiled form into one of said input and said output modules and configured to travel through at least one space defined in said marking modules.

9. A method for installation of an endless belt within a modular printing system, comprising the steps of:

providing at least two rollers to support said belt, providing means to detachably mount said rollers to a frame structure of said system, drawing said rollers out of said frame structure, placing said belt in coil form within said frame structure, providing an input module;

extending said belt to an operating position, and restoring said rollers to their original location, thereby capturing said belt in its operating position.

10. The method of claim 9 wherein at least one of said rollers is a driver roller.

11. The method of claim 9 wherein at least one of said rollers is a tensioning roller.

12. The method of claim 9 wherein said belt is configured at any length conforming to the distance between rollers in said printing system.

13. The method of claim 9 comprising providing at least one marking module, the marking module containing removable marking module rollers, said rollers configured to be removable before installation of said endless belt.

14. The method of claim 9 comprising at least one marking module.

15. The method of claim 9 comprising providing an output module.

16. The method of claim 9 comprising marking modules, each having aligned spaces therein, said spaces configured to allow passage there through of said endless belt.

17. The method of claim 9 comprising from one to eight marking modules.

18. The marking system of claim 9 comprising said coiled endless belt positioned in said input module and configured to travel through at least one marking module to an output module.

19. The method of claim 9 comprising said coiled endless belt positioned in an output module and configured to travel through at least one marking module to said input module.

* * * * *